United States Patent [19]

Thiel et al.

[11] Patent Number: 4,827,185

[45] Date of Patent: May 2, 1989

[54] COLOR PICTURE TUBE HAVING INTERNAL CONDUCTIVE COATINGS

[75] Inventors: Norbert Thiel, Esslingen; Volker Gerstle, Lorsch; Rolf Zondler, Stuttgart; Otto Lederle, Esslingen, all of Fed. Rep. of Germany

[73] Assignee: Nokia Graetz GmbH, Pforzheim, Fed. Rep. of Germany

[21] Appl. No.: 194,816

[22] Filed: May 17, 1988

Related U.S. Application Data

[62] Division of Ser. No. 844,109, Mar. 26, 1986, Pat. No. 4,762,733.

[30] Foreign Application Priority Data

Mar. 28, 1985 [DE] Fed. Rep. of Germany ..... 3511211

[51] Int. Cl.[4] ..... H01J 29/88

[52] U.S. Cl. ..... 313/479; 313/477 R

[58] Field of Search ..... 313/479, 480, 477 HC, 313/477 R; 427/126.1, 126.2, 126.3, 126.4, 105, 108; 752/510, 506, 508

[56] References Cited

U.S. PATENT DOCUMENTS 4,124,540 11/1978 Foreman et al. ..... 313/479 X 4,550,032 10/1985 Compen et al. ..... 313/479 X

*Primary Examiner*—Kenneth Wieder

*Attorney, Agent, or Firm*—Peter C. Van Der Sluys

[57] ABSTRACT

In a color-picture tube, the conductive coating on the inside of the cone is a suspension without organic constituents. The conductive coating on the inside of the neck, which is contiguous to the conductive coating on the inside of the cone, consists of the aforementioned suspension with an addition of organic constituents. A sharp and scratch-resistant boundary between the conductive coating in the neck and the uncoated area of the neck is thus obtained.

4 Claims, 2 Drawing Sheets

COLOR PICTURE TUBE HAVING INTERNAL CONDUCTIVE COATINGS

This is a divisional of co-pending application Ser. No. 844,109 filed on Mar. 26, 1986, now U.S. Pat. No. 4,762,733.

BACKGROUND OF THE INVENTION

The present invention relates to a color-picture tube and to a method of manufacturing the color-picture tube.

DE-OS No. 27 42 741 discloses a color-picture tube having a conductive coating on the inside of the cone. The coating is made of graphite, iron oxide, and a silicate binder. The entire inside of the neck of the color-picture tube is coated with a film of vaporizable material, e.g., polyvinyl alcohol. This film serves to protect the neck during the insertion of the electron-gun system. After the electron-gun system has been mounted, the film in the neck is vaporized.

To avoid sparkover between the conductive coating in the cone, which is at high electric potential, and the electron-gun system, there must be a sharp boundary between the conductive coating and the uncoated area. The thickness of the coating must be very uniform, and the boundary region between the coated and uncoated areas must be very smooth, because otherwise material of the coating would easily crumble away at bulging transitions, particularly when the centering and contact springs of the electron-gun system are moved over the boundary.

DE-OS No. 29 03 735 discloses a method of applying a conductive coating to the cone of a color-picture tube which comprises the steps of covering the areas which are to remain free of the coating with a lacquer film, then depositing the conductive coating, and finally washing away the lacquer film and the conductive coating resting on the film.

SUMMARY OF THE INVENTION

One object of the invention is to provide a color-picture tube of the above kind in which there is a sharp and scratch-resistant boundary between the conductive coating and the uncoated area in the neck.

A further object is to provide a simple method of manufacturing such color-picture tubes.

In a color-picture tube in accordance with the invention, the conductive coating on the inside of the cone is a suspension without organic constituents and a conductive coating is provided on the inside of the neck, which is contiguous to the conductive coating on the inside of the cone, and consists of the aforementioned suspension with an addition of organic constituents. A sharp and scratch-resistant boundary between the conductive coating in the neck and the uncoated area of the neck is thus obtained.

BRIEF DESCRIPTION OF THE DRAWING

The invention will be better understood from a reading of the following detailed description in conjunction with the drawing in which.

DETAILED DESCRIPTION

Figure 1:
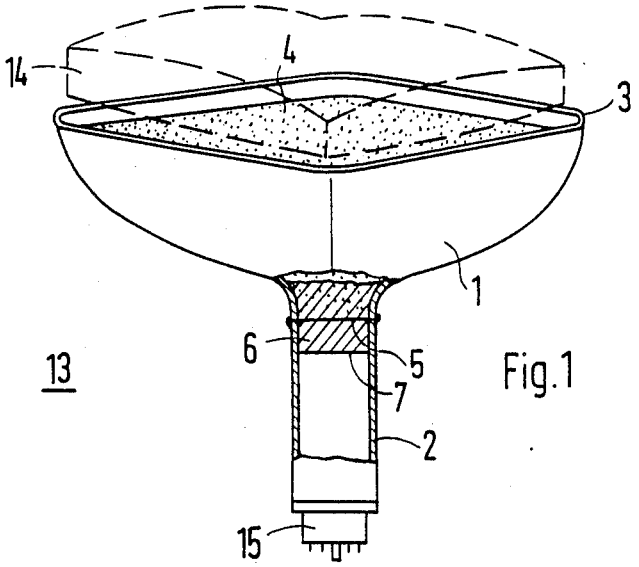
FIG. 1 is a perspective view of a color-picture tube, partly broken way and partly in section.

FIG. 1 shows the cone 1 and the neck 2 of a color-picture tube 13 which further comprises a mask-faceplate assembly 14 (outlined by dashed lines and slightly lifted) and a base 15. At the upper rim of the cone 1, the seal surface to which the mask-faceplate assembly 14 is to be joined is designated 3. The first conductive coating on the inside of the cone 1 is shown dotted and is designated by the reference numeral 4. This coating 4 extends down to the seal line 5 between the neck 2 and the cone 1. On the inside of the neck 2, there is a portion with a second coating 6 (shown hatched) which is contiguous to the first coating 4. The boundary between this second coating 6 and the uncoated area in the neck 2 is designated 7. The second coating 6 may extend beyond the seal line 5 and overlap the first coating 4, as shown in FIG. 1.

The coating 4 contains no organic constituents and consists, for example, of a graphite suspension with an admixture of iron powder or other nonconductive inorganic constituents for setting the electric resistance, such as $TiO_2$, $AL_2O_3$, and $SiO_2$, and a silicate binder. The coating 6 consists of the suspension of the coating 4 with an admixture of organic constituents. The organic constituents are, for example, polyvinyl pyrrolidone, polyvinyl alcohol, casein, and polyvinyl acetate. The use of a suspension without organic constituents for the first coating 4 permits short frit-sealing times which joining the mask-faceplate assembly 14 to the cone 2, and shorter pumping times at a lower peak temperature, without any adverse effects on the tube vacuum and tube life. To avoid the disadvantage of an unsharp and non-abrasion-resistant boundary between this suspension and an uncoated area, the first coating 4 is adjoined by the second coating 6, which is a suspension that gives a sharp boundary.

Figure 2:
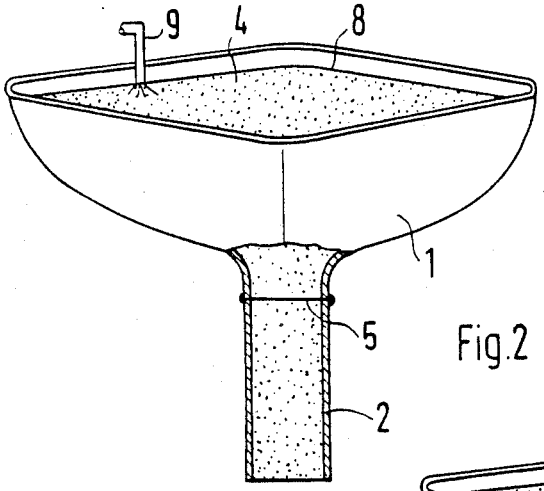
FIG. 2 to 5 show different steps of the method of manufacturing the color-picture tube.
Figure 3:
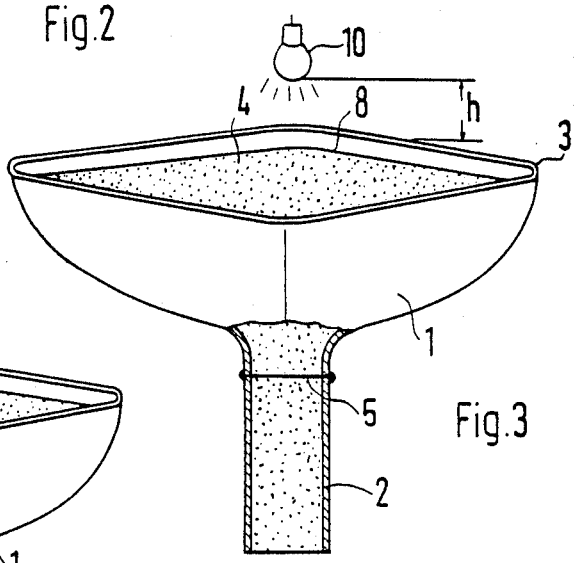

The method of making the color-picture tube of FIG. 1 will now be described with the aid of FIGS. 2 to 5. The carefully cleaned cone 1 and the neck 2 joined thereto are covered with the first conductive coating by any of the conventional techniques. In the example of FIG. 2, the first coating is applied by pouring in the suspension through the end 9 of the tube that is guided along the boundary 8. In this manner, the entire inside surface of the cone 1 and the entire inside surface of the neck 2 are covered with this coating (shown dotted). Then, the anode contact in the cone 1 is uncovered by blowing (not shown), and the first conductive coating 4 is dried. The drying is done with infrared lamps 10, of which only one is shown in FIG. 3. The distance h between the lower edge of the infrared lamp 10 and the seal surface 3 is chosen so that the coating 4 will dry between the boundary 8 and the seal line 5 while remaining wet between the seal line 5 and the free end of the neck. This can also be accomplished with an infrared lamp located at a fixed distance h by suitably adjusting the heating power of the lamp.

Figure 4:
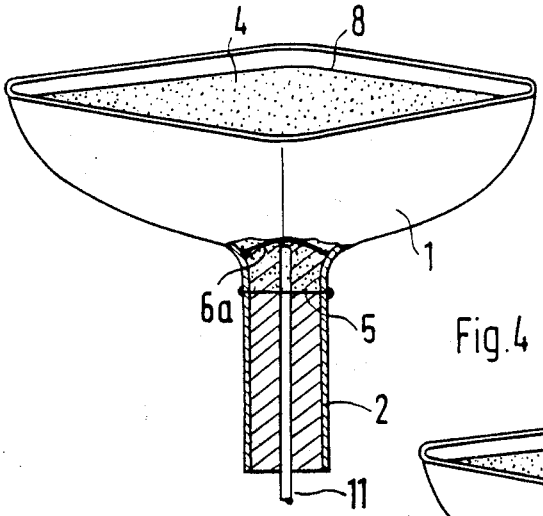
Figure 5:
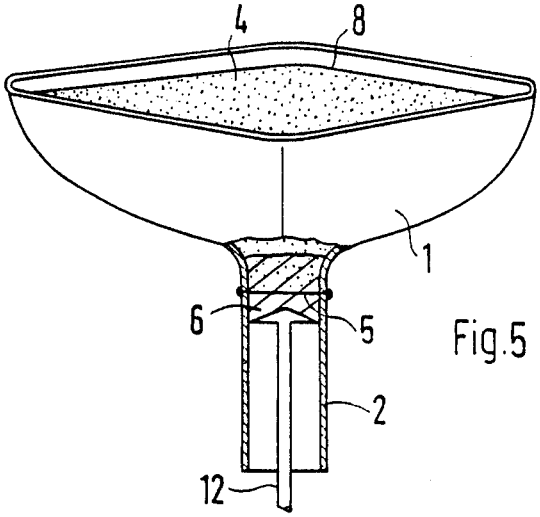

As shown in FIG. 4, the wet portion of the coating 4 below the seal line 5 is then removed by rinsing out the neck 2 with the suspension of the subsequently applied second coating. To do this, a tube 11 is introduced into the neck 2 from below. The suspension 6*a* (shown hatched) of the subsequent second coating emerges from the upper end of the tube 11, which rises slightly above the seal line 5. The suspension 6*a* also washes over a small portion of the dried coating 4 in the transition region from the cone 1 to the neck 2, but this portion is not washed away. Only the wet coating below the seal line 5 is removed and replaced by the suspension of the second coating. After removal of the tube 11, this second coating in the neck 2 is dried with, e.g., a heater fan. The area which is to remain free of the second coating 6 in the neck 2 is then rinsed with alkali hydroxides, preferably a 0.5 to 10% sodium hydroxide solution, and then cleaned with a wiper 12 and water. In a preferred embodiment, the rinsing is done with a 0.5 to 2% sodium hydroxide solution. Thereafter, the neck may be cleaned with hydrofluoric acid. Finally, the neck is rinsed inside and outside with demineralized water. For cleaning the outside of the neck, a ring brush (not shown) may be used.

What is claimed is:

1. A color-picture tube comprising:

a cone;

a first conductive coating without organic constituents on the inside of said cone;

a neck adjacent said cone; and a second coating on an area inside said neck, said second coating being contiguous to said first coating and consisting of a suspension of said first coating with an addition of organic constituents.

2. A color-picture tube in accordance with claim 1, wherein:

said organic constituents consist of polyvinyl pyrrolidone.

3. A color-picture tube in accordance with claim 1, wherein:

the boundary line between said first coating and said second coating coincides with the seal line between said neck and said cone.

4. A color-picture tube in accordance with claim 1, wherein:

said second coating slightly overlaps said first coating.

* * * * *